US005871821A

United States Patent [19]

Kondo et al.

[11] Patent Number: 5,871,821

[45] Date of Patent: Feb. 16, 1999

[54] CURTAIN COATING WITH DYNAMIC SURFACE TENSION CONTROL OF LAYERS

[75] Inventors: Yoshikazu Kondo; Koji Fukazawa; Akira Nishiwaki, all of Tokyo, Japan

[73] Assignee: Konica Corporation, Japan

[21] Appl. No.: 823,884

[22] Filed: Mar. 17, 1997

[30] Foreign Application Priority Data

Mar. 21, 1996 [JP] Japan ..... 8-064418

[51] Int. Cl.[6] ..... B05D 1/30

[52] U.S. Cl. ..... 427/420; 118/DIG. 4

[58] Field of Search ..... 427/420; 118/DIG. 4

[56] References Cited

U.S. PATENT DOCUMENTS

H1003 12/1991 Ishiwata et al. ..... 427/420

4,569,863 2/1986 Koepke et al. ..... 427/420

4,942,068 7/1990 Schweicher et al. ..... 427/420

*Primary Examiner*—Katherine A. Bareford

*Attorney, Agent, or Firm*—Jordan B. Bierman; Bierman, Muserlian and Lucas

[57] ABSTRACT

A method for producing light-sensitive material by using a curtain layer of coating solution. The method includes the steps of: discharging coating solution, including the light-sensitive material, from a coater die; forming a curtain layer of coating solution by causing the coating solution to fall from a die lip of the coater die in which the coating solution has at least 3 layers and a relational structure of dynamic surface tensions of the layers, satisfying the equation: $\Delta K = \sigma intermediate_{min} - \sigma outer_{max} \geqq 0$[mN/m] in which, $\sigma intermediated_{min}$ [mN/m] represents the minimum value of dynamic surface tension of an intermediate layer among the layers, $\sigma outers_{max}$ [mN/m] represents the maximum value of dynamic surface tension of an outer layer among the layers; and coating a continuous support with the coating solution.

2 Claims, 1 Drawing Sheet

CURTAIN COATING WITH DYNAMIC SURFACE TENSION CONTROL OF LAYERS

BACKGROUND OF THE INVENTION

The present invention relates to a light-sensitive material production method wherein a curtain coater is used to manufacture light-sensitive materials through stable curtain coating.

There has been known a method for manufacturing light-sensitive materials by the use of a curtain coater wherein a coating solution in a form of a uniform layer flowing down along a slide surface of a coater die is caused to fall from a tip of a die lip of the coater die to be formed into a thin curtain layer of coating solution which is, then, put continuously on a web of a long support to be coated thereon, while the support is running at a certain high speed. In a method for manufacturing light-sensitive materials by the use of the curtain coater mentioned above, it is very important that a curtain layer is formed in a stable manner. When the coating solution flowing down along the slide surface leaves the die lip to be formed into a curtain layer, the coating solution whose surface tension makes it to shrink is held by a bar (or a plate) located at the side and called an edge guide so that a width of the curtain layer may be secured. However, when the edge guide fails to resist a force of the coating solution to shrink, a broken curtain layer is caused, making it difficult to form a curtain layer in a stable manner. In a prior art, there happened frequently phenomena wherein a curtain layer has been broken without being formed, or, even if it is formed, a curtain layer on the side edge is broken simultaneously with the start of coating by a force with which a coating solution is pulled in the direction of conveyance of a support, due to a lack of a force of the edge guide to support the curtain layer. For eliminating these phenomena, there have been made various proposals.

Namely, Japanese Patent Publication Open to Public Inspection No. 99668/1989 (hereinafter referred to as Japanese Patent O.P.I. Publication) discloses a means to strengthen and stabilize a curtain layer by causing side solutions to flow additionally on end portions at both sides for improving the foregoing by preventing the broken curtain layer. In this means, however, the side solution is accumulated on each end portion intensively, resulting in an excessively thick layer on each of both sides, although the curtain layer is not broken.

For the intent of inhibiting the increase in a layer thickness on each side, coating solutions on a thick layer portion on an end portion of a curtain layer at the edge guide section are removed through suction, as disclosed in Japanese Patent O.P.I. Publication Nos. 477/1986 and 233954/1994.

In Japanese Patent O.P.I. Publication No. 57734/1976, curtain layer is stabilized by the use of an edge guide of a flat plate type. However, even in this case, a curtain layer can not be stabilized, and some types of coating solutions make it impossible to form a curtain layer. A problem of the phenomenon that both edges of a curtain layer are caused to be thick can not be solved either.

As stated above, various types of coating apparatuses have been proposed so far for forming a curtain layer, but none of them is satisfactory.

SUMMARY OF THE INVENTION

In the invention, its object is to study the relation between coating solutions in terms of dynamic surface tension without adding any facilities or without changing any equipment and to find out a method wherein a curtain layer can be formed more stably and light-sensitive materials can be manufactured through stable coating.

The object mentioned above can be attained by the following technical means.

A light-sensitive material production method characterized in that coating is made, in manufacture of a light-sensitive material wherein a curtain coater is used for coating simultaneously on a continuous support three or more layers at the total flow rate of 1.0 cc/sec/cm or more, by using coating solutions having the following relational structure of their dynamic surface tensions, satisfying the equation:

$$\Delta K = \sigma\text{intermediate}_{min} - \sigma\text{outer}_{max} \geqq 0 [mN/m]$$

wherein, σ intermediate$_{min}$ [mN/m] represents the minimum value of dynamic surface tension (DST) of an intermediate layer among aforementioned three or more layers, while σ outer$_{max}$ [mN/m] represents the maximum value of DST of an outer layer (uppermost layer and lowermost layer) among aforementioned three or more layers.

Namely, the inventors of the invention found, after their studies, that stability of a curtain layer is greatly dependent on the relational structure of dynamic surface tensions (DST) of coating solutions, especially in the case of a complicated system where the number of layers is three or more. Their further studies made it clear that the stability of a curtain layer is greatly dependent on the relation between DST of an intermediate layer and that of an outer layer (uppermost layer and lowermost layer) of a curtain layer. As a result of their studies for 3-layer, 5-layer, 7-layer, 9-layer and 16-layer systems, it was found that the greater value of ΔK [mN/m] makes both stability of a curtain layer and coatability to be improved in all the systems studied. In this case, the DST was measured in accordance with "A New Method of Measuring Dynamic Surface Tension" in Journal of Colloid and Interface Science. Vol.77 No.2 October 1980.

DETAILED DESCRIPTION OF THE INVENTION

Figure 1:
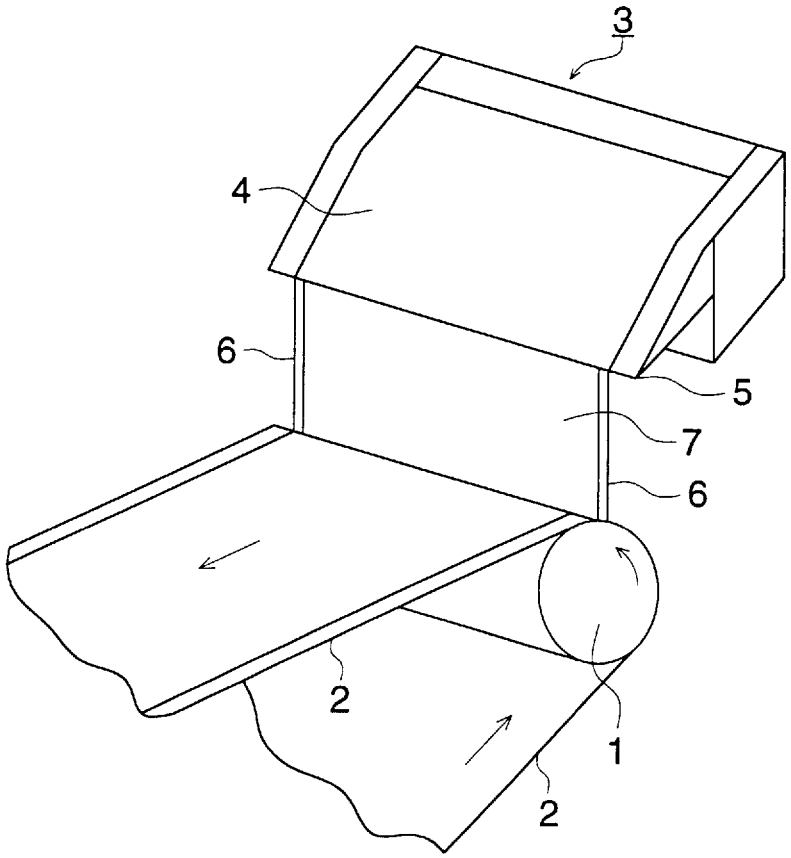
FIG. 1 is a perspective view of a curtain layer forming section of a curtain coater in the invention.

A coater used in a production method of the invention will be explained as follows, referring to a perspective view in FIG. 1. Long support 2 is wound around back roller 1 so that the support can be conveyed in the arrowed direction at a constant speed. Coater die 3 is provided to be off and above the back roller 1 diagonally, and plural layers of coating solutions flow down, while forming their uniform layer thickness, along slide surface 4 of the coater die 3 to the tip portion of die lip 5 to fall therefrom to form a thin curtain layer. In this case, both sides of curtain layer 7 are put on support 2 which is running at the constant speed while a uniform layer is being formed and maintained due to dynamic surface tension (DST) generated between edge guide 6 and the curtain layer, thus, continuous coating is achieved.

The edge guide 6 is a straight and bar-shaped one provided to be vertical as shown in FIG. 1. The bar-shaped edge guide mentioned above is a round bar or a square bar made of stainless steel.

In experiments in the example of the invention, though the number of layers to be multi-layer-coated simultaneously is represented by 3, 5, 7, 9, and 16. the invention is not limited to these numbers.

The results of the example of the invention will be explained in detail as follows. In the following example, an appropriate amount of anionic surface active agent aqueous solution was added to a 7% gelatin aqueous solution, and the mixture was adjusted to the desired DST. After that, the mixture was adjusted with thickening agents to 30 cp.

EXAMPLE

Example 1

Basic conditions of the experiments

Figure 2:
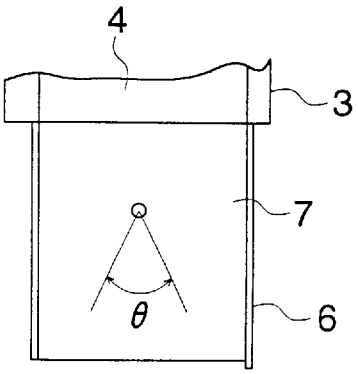
FIG. 2 is an illustration showing how DST is measured in a curtain layer breakdown test.

- Composition of each coating solution: 7% gelatin solution adjusted by thickening agents to 30 cp
- Total flow rate: 1, 2, 3 and 4 cc/sec/cm
- Layer structure: 3-, 5-, 7-, 9- and 16-layer
- Curtain height: 30–300 mm
- Coating speed: Durability of a curtain layer was measured at the coating speed of 180, 300 and 420 m/min (3, 5 and 7 m/sec).
- Curtain layer width: 300 mm
- Edge guide: Round bar and square bar both made of stainless steel Evaluation symbol A: Capable of coating Evaluation symbol B: Curtain layer breakdown took place after the start of coating Evaluation symbol C: Curtain layer breakdown In "Capable of coating" of evaluation symbol A;

$A_3$: Capable of coating at the coating speed up to 3 m/sec $A_5$: Capable of coating at the coating speed up to 5 m/sec $A_7$: Capable of coating at the coating speed up to 7 m/sec Incidentally, for measurement of DST of each solution, a curtain layer breakdown test shown in an illustration in FIG. 2 was employed. Further, as a method of evaluating curtain layer stability and coating stability, coating speed (m/sec) capable of coating at each system was compared.

Based on the foregoing, formation of coated layers, namely stability of coating status was verified by changing ΔK value of DSK, Q value of total flow rate and dimensions and shapes of an edge guide for each case of layer structures of 3-, 5-, 7-, 9- and 16-layer. The results of the aforementioned verification are described as working of the invention in Tables 1–5 below.

TABLE 1

| 3-layer system | | | |
|---|---|---|---|
| ΔK | Total flow rate Q (cc/sec/cm) | | |
| (mN/m) | 1 | 2 | 3 |
| −4 | C | C | B |
| −2 | C | C | B |
| ±0 | A3 | A3 | A3 |
| +2 | A3 | A3 | A3 |

TABLE 2

| 5-layer system | | | |
|---|---|---|---|
| ΔK | Total flow rate Q (cc/sec/cm) | | |
| (mN/m) | 2 | 3 | 4 |
| −2 | B | B | B |
| ±0 | A3 | A3 | A3 |
| +2 | A3 | A3 | A3 |
| +5 | A5 | A5 | A3 |

TABLE 3

| 7-layer system | | | |
|---|---|---|---|
| ΔK | Total flow rate Q (cc/sec/cm) | | |
| (mN/m) | 1 | 2 | 3 |
| −5 | C | C | C |
| ±0 | A3 | A3 | A3 |
| +4 | A3 | A3 | A5 |
| +8 | A3 | A5 | A5 |
| +10 | A5 | A7 | A7 |

TABLE 4

| 9-layer system (Total flow rate 3 cc/sec/cm) | | | |
|---|---|---|---|
| | Edge guide shape and dimensions | | |
| ΔK (mN/m) | 2ϕ type | 4ϕ type | Flat plate type |
| −5 | C | C | B |
| ±0 | A3 | A3 | A3 |
| +4 | A3 | A5 | A5 |
| +8 | A3 | A5 | A7 |
| +10 | A5 | A7 | A7 |

TABLE 5

| 16-layer system | | | |
|---|---|---|---|
| ΔK | Total flow rate Q (cc/sec/cm) | | |
| (mN/m) | 1 | 2 | 3 |
| −5 | C | C | B |
| ±0 | A3 | A3 | A3 |
| +4 | A3 | A3 | A3 |
| +8 | A3 | A3 | A5 |
| +10 | A3 | A3 | A5 |

It is understood from the foregoing that $\Delta K \geqq 5$ [mN/m] is preferable as a value of ΔK and $\Delta K \geqq 10$ [mN/m] is more preferable as a value of ΔK.

The invention has achieved, by prescribing the relation between coating solutions in terms of dynamic surface tension, without adding any facilities or changing any equipment, a method wherein a curtain layer can be formed more stably and light-sensitive materials can therefore be manufactured through stable coating.

What is claimed is:

1. A method for coating a substrate with a coating solution comprising discharging said coating solution, including a light-sensitive photographic material, from a coater die;

forming a curtain layer of said coating solution by causing said coating solution to fall from a die lip of said coater die;

wherein said coating solution has at least 3 layers and a relational structure of dynamic surface tensions of said layers, satisfying the equation:

$$\Delta K = \sigma\text{intermediate}_{min} - \sigma\text{outer}_{max} \geqq 0 (mN/m)$$

wherein, σ intermediates$_{min}$ (mN/m) represents the value of dynamic surface tension of an intermediate layer with the lowest dynamic surface tension of all intermediate layers, σ outer$_{max}$ (mN/m) represents the value of dynamic surface tension of an outer layer with the greater dynamic surface tension of two outside layers; and coating a continuous support with said coating solution.

2. The method of claim 1, wherein said coating step is carried out so that said continuous support is coated with said coating solution at a total flow rate of not less than 1.0 cc/sec/cm.

* * * * *